US005511345A

United States Patent [19]

Jones et al.

[11] Patent Number: 5,511,345

[45] Date of Patent: Apr. 30, 1996

[54] UNITARY MOLDED PLASTIC STRUCTURAL MEMBER, LID FORM AND LAWN CRYPT CONSTRUCTED FROM SAME

[75] Inventors: Dale C. Jones; Michael A. Lacy, both of Conyers, Ga.

[73] Assignee: Vantage Products Corporation, Conyers, Ga.

[21] Appl. No.: 90,677

[22] Filed: Jul. 13, 1993

[51] Int. Cl.[6] ..... E04H 13/00; E04C 2/32

[52] U.S. Cl. ..... 52/136; 52/70; 52/142; 52/284; 52/582.1; 52/630

[58] Field of Search ..... 52/65, 70, 71, 52/582.1, 591.1, 591.2, 591.5, 281, 284, 285.1, 285.4, 270, 272, 136, 134, 139, 142, 137, 630

[56] References Cited

U.S. PATENT DOCUMENTS

| | | | |
|---|---|---|---|
| 795,527 | 7/1905 | Loresch | 52/139 |
| 3,230,674 | 1/1966 | Christensen | 52/137 |
| 3,618,991 | 11/1971 | Edwards et al. | 52/285.4 |
| 3,772,826 | 11/1973 | Ferver | 52/137 |
| 3,958,378 | 5/1975 | Omeechevarria | 52/136 |
| 4,648,219 | 3/1987 | Johnston, Sr. | 52/136 |
| 4,880,210 | 11/1989 | Cucksey | 52/70 |

*Primary Examiner*—Michael Safavi
*Attorney, Agent, or Firm*—Seidel Gonda Lavorgna & Monaco

[57] ABSTRACT

A lawn crypt is fabricated from molded unitary plastic structural members. The structural members are attached to one another so as to inhibit lateral movement therebetween by pins inserted through interengaging protuberances extending outward from the sides of the structural members. The protuberances resemble half-circles or partially open knuckles. Every adjacent protuberance of each structural member opens in the opposite direction. The lawn crypt allows burial chamber lids to be cast in place by the use of a unitary plastic molded lid form that becomes part of the lid after casting. The lid form includes molded-in sockets for restraining concrete reinforcing bars placed therein.

15 Claims, 9 Drawing Sheets

UNITARY MOLDED PLASTIC STRUCTURAL MEMBER, LID FORM AND LAWN CRYPT CONSTRUCTED FROM SAME

FIELD OF THE INVENTION

This invention relates to a below ground burial structure and in particular to a burial structure fabricated of molded plastic structural members designed to allow easy assembly of adjacent individual members to one another. The invention also relates to a system for allowing burial chamber lids of the lawn crypt to be cast in place by the use of a plastic molded form that becomes part of the lid after casting. The invention is described in the context of, but is not limited to, a lawn crypt with burial chambers having shared walls.

BACKGROUND OF THE INVENTION

Traditional burial procedures involve excavating an individual grave site, placing a casket therein, and refilling the excavation site with soil. Such a technique is very wasteful of space because only a single grave site may be located at any one spot. Furthermore, the grave sites must be spaced laterally from each other by an amount sufficient to preserve the integrities thereof. One solution to the space disadvantages of the traditional burial procedure is to construct so-called "lawn crypts" or "underground burial fields." These lawn crypts are constructed by excavating a pit in the grounds of a cemetery and installing an array of individual burial chambers therein. Each burial chamber may have multiple tiers, typically two, or may have only one level. Typically, adjacent burial chambers share adjacent walls. Once the array of burial chambers is constructed, lids are placed on top of each chamber and the outer perimeter and top of the lawn crypt are covered with soil. When access to a particular burial chamber is desired, such as to place a casket therein, earth moving equipment removes the soil covering the particular burial chamber, exposing its lid. The lid is then removed, thereby allowing access to the chamber below. After the casket is placed in the chamber, this process is reversed. Examples of such lawn crypts are shown in U.S. Pat. No. 4,648,219 and U.S. Pat. No. 4,134,239.

U.S. Pat. No. 4,648,219 discloses a lawn crypt comprising an array of contiguous chambers formed by a plurality of load-bearing side panels and end panels supported on a base slab of reinforced concrete. Adjacent ones of the chambers share either one of the side panels or one of the end panels. A horizontal divider structure 100 within each of the chambers divides each chamber into an upper vault and a lower vault.

Referring to FIG. 1 of that patent, the side and end panels are joined together by angle connectors such as connector 123 which joins end panel 62 to side panel 46. Each of the side panels, such as 34, illustrated in FIG. 2 of that patent, is provided with two holes 88 and 90 positioned along the longitudinal centerline for each of the side panels. The side panels also include reinforcing bar, or rebar structure 128 and lifting inserts 124 and 126 cast therein. As illustrated in FIG. 1, horizontal rods 92 and 94 are inserted respectively into the holes 88 and 90 of the side panel 34 and corresponding holes in oppositely disposed side panel 46. Thus, the rods 92 and 94 are supported by the side panels 34 and 46. The end panels 52, 54, 56, 58, 60 and 62, illustrated in FIG. 3, each include a rebar structure 132 and a lifting insert 130 cast therein. The lawn crypt further includes a plurality of top panels (lids) such as 70, 72, 74, 76, 78 and 80, best illustrated in FIG. 4 of that patent. These top panels also have a rebar structure 138 cast therein and also have two lifting inserts 134 and 136. The lifting inserts are best illustrated in FIG. 6. When the crypt is constructed, and initially covered with earth, the divider 100 and the horizontal rods 92 and 94 are not in place.

As each grave site is required, earth moving equipment uncovers the top panel above the required chamber. Eye hooks are then inserted into the lifting inserts, such as 134 and 136 of a top panel 70. Once the top panel is lifted out of place, a casket is received into the lower vault 104 of the chamber 22. Next, the horizontal rods 92 and 94 are inserted into the respective holes in the side panels, such as 34 and 46. The horizontal divider 100 is then lowered into the chamber 22 to divide it into the upper vault 102 and the lower vault 104. The top panel 70 is then replaced and the earth fill returned to its original location.

The side panels, end panels and top panels (lids) in U.S. Pat. No. 4,648,219 are apparently cast off-site and trucked to the lawn crypt installation site.

U.S. Pat. No. 4,134,239 discloses a burial field system comprising one or more tiers of burial chambers formed from commonly shared wall sections placed on a concrete slab or floor.

Referring to FIGS. 1 and 2 of that patent, exemplary chamber 46 is defined by common wall sections such as 38, 40, 42 and 44. These wall sections also serve as wall sections for surrounding chambers 48, 50, 52 and 54. Adjacent wall sections are apparently butted up against each other and caulked. Upper and lower tiers of each chamber are separated by an intermediate cover, structure and the uppermost tier is covered by a cover member. For example, upper chamber 26 and lower chamber 24 are separated by intermediate cover structure 28 and the upper chamber 26 is covered by cover member 30.

FIG. 3 of that patent shows the details of construction. The burial chambers are formed from two different types of wall sections 58 and 60. The wall sections 60 have ledges 66 and 68 on opposite sides thereof. Starting from the bottom of a chamber and working upward, support strips 74 are placed on the concrete slab or floor to elevate the casket placed in the lower chamber slightly above the surface of the floor. Intermediate cover structures 28 formed from a plurality of cover sections 70 are placed along the ledges 66 and 68 to seal off the lower chamber from the upper chamber. (When the burial chamber is originally constructed and covered with earth, the cover sections 70 are not in place.) The uppermost tier of chambers is closed by separate cover members 30 which overlie their respective upper tier chambers. Each cover member 30 is provided with pairs of hooks or eyes 72 and 73 at its opposite ends so as to allow for easy locating and removal of the cover members 30 when access to a chamber is desired.

The process for initially preparing the grave site, and the process for gaining access to a chamber and reclosing the chamber after a burial is substantially identical to U.S. Pat. No. 4,648,219, described above.

One prior art technique for creating concrete-reinforced lids for covering burial chambers of lawn crypts is to set a form on the ground, place rebar in the form, tie the rebar together to keep it from moving when concrete is poured into the form, and then fill the form with concrete. Once the concrete has hardened, the form is removed and the lid is moved to the installation site. This technique has obvious disadvantages. First, the number of lids that can be made at one time is limited by the number of forms available and the availability of level ground on which to set the forms.

Second, whether the lids are formed off-site and trucked to the installation site, or whether they are formed at the installation site, the lids must be lifted or moved from the forming location so that they can be placed on top of the burial chambers.

Heretofore, the prior art lawn crypts known to the inventor have been constructed from concrete walls, either cast off-site and trucked to the installation site or cast on-site by erecting forms and pouring concrete therein. On-site casting of walls is very time-consuming. It can typically take several months to cast all of the units in a large lawn crypt during which time a large excavated area is exposed to public view. Furthermore, employing concrete for constructing the walls results in significant material and labor costs, whether the walls are cast on-site or off-site. If the walls are cast off-site, they must be shipped and maneuvered into place, thereby significantly adding to the time and cost associated with building a lawn crypt.

Accordingly, there is still a need for a lawn crypt installation system which minimizes material costs and installation time and which can be erected using simple techniques and light-weight components which are easily fabricated and connected together. The present invention fills that need.

SUMMARY OF THE INVENTION

The present invention is directed to a system for constructing a burial field of underground burial crypts. Adjacent burial chambers are formed on an excavated or partially excavated plot of land from a plurality of vertical walls. The uppermost portion of the vertical walls defines an upper ledge. Each burial chamber is then covered by placing a unitary lid form on the upper ledge of each respective chamber. Each lid form has a solid bottom and side walls extending upward from the solid bottom. The side walls define a recess in the lid form. The side walls are shaped substantially similar to the shape of the upper ledge. Next, each lid form is filled with concrete and a sufficient amount of time is allowed for the concrete to harden in the lid form, thereby creating a lid for each burial chamber. The concrete filled lids and any exposed walls are then covered with earth fill.

In another embodiment, the invention is directed to a method of casting in place lids which cover the top of an underground burial crypt having adjacent burial chambers. In this method, the lid forms are placed substantially adjacent to one another so that the top of the burial crypt is substantially covered by the lid forms. The lid form recesses are then filled with concrete.

In yet another embodiment, the invention is directed to a unitary plastic lid form designed to be filled with concrete reinforcing elements and concrete, thereby creating a reinforced concrete lid for covering the top of an underground burial crypt having adjacent burial chambers. The lid form includes a solid bottom, side walls extending upward from the solid bottom, and socket means on an interior surface of the lid form for restraining the concrete reinforcing elements. The side walls define a recess to be filled with the concrete. The socket means include spaced saddle sockets and spaced pairs of extension ribs.

In still another embodiment, the invention is directed to a burial crypt covered by lids created from the unitary lid form.

In still another embodiment, the invention is directed to a unitary molded structural member for building wall sections of adjacent molded structural members that are inhibited from lateral movement therebetween. Each member includes a polygonal wall portion having two opposite straight sides and a plurality of spaced protuberances extending outward from the sides. Each protuberance defines a partially enclosed space. Every adjacent protuberance opens in the opposite direction. The protuberances are axially aligned along the sides so that an unobstructed passage exists perpendicular to the protuberances. The passage intersects a space defined by the partially enclosed spaces. The protuberances on one of the sides are staggered relative to the protuberances on the other side so that protuberances on one side of an adjacent member interfit in the spaces between the protuberances of one of the sides of the member, and so that a pin can be inserted through the passage of adjacent interfit members, thereby inhibiting lateral movement therebetween. The partially enclosed space of the protuberance is a half-circle.

In still another embodiment, the invention defines a method for constructing closed polygonal forms from the unitary molded structural members. One side of a first member is placed adjacent to one side of a second member. The protuberances on the side of the first member are staggered with respect to the protuberances on the side of the second member so that the protuberances on respective sides interfit in the spaces therebetween. Then, the respective sides are aligned so that the passage of the first member matches up with the passage of the second member. A pin is then placed into the passage, thereby inhibiting lateral movement of the first member with respect to the second member.

In still another embodiment, the invention is directed to a system for connecting together corners of adjacent walls built from the structural members so as to inhibit lateral movement therebetween.

In still another embodiment, the invention is directed to a burial crypt constructed with the structural members.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DESCRIPTION OF THE PREFERRED EMBODIMENT

Figure 1:
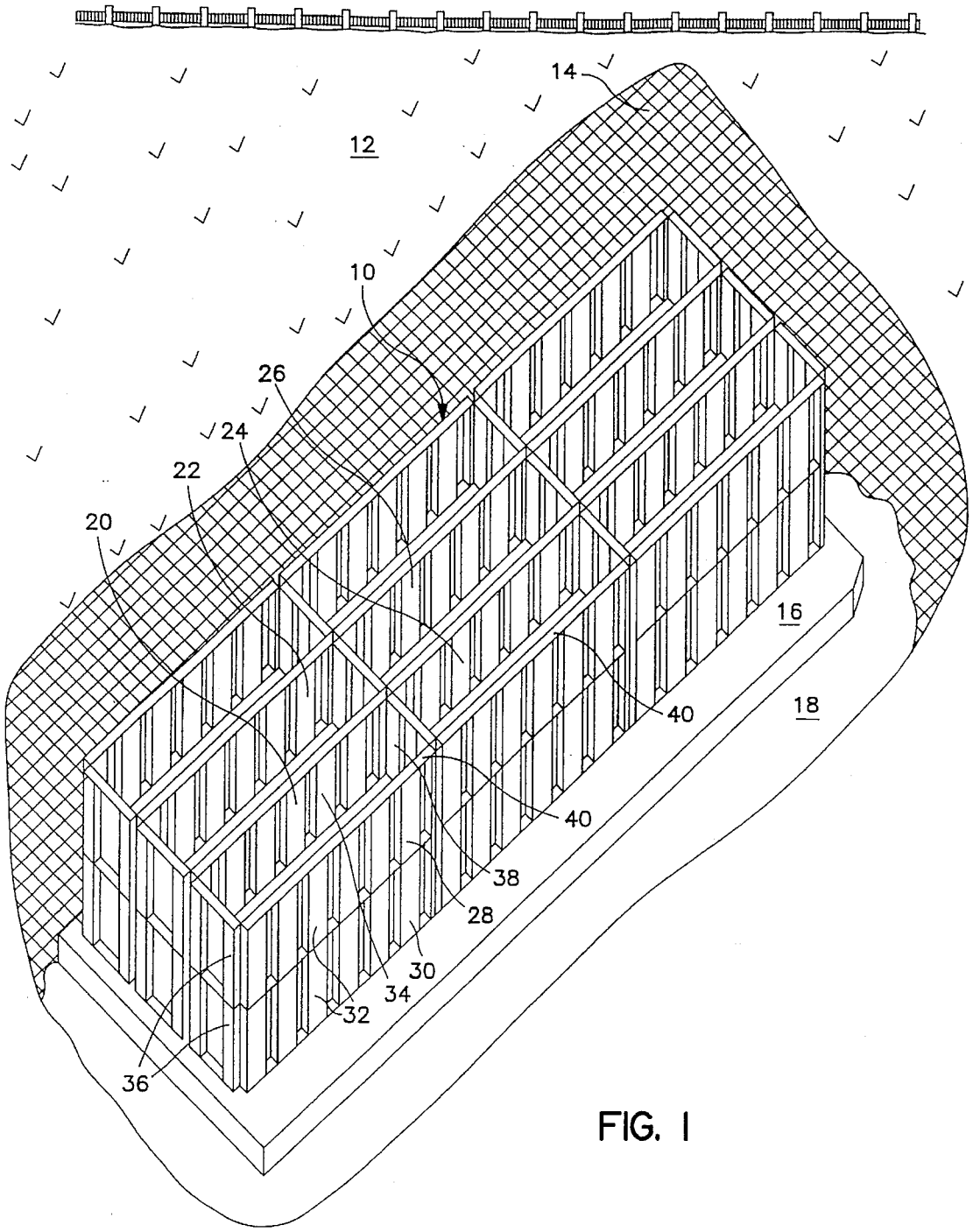
FIG. 1 is perspective view of an exposed and uncovered lawn crypt within the setting of a cemetery site constructed with molded structural members and corner attachment components in accordance with one embodiment of the present invention.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

Apparatus depicting the preferred embodiments of the novel lawn crypt construction system and structural member attachment system are illustrated in the drawings.

Referring now to FIG. 1, there is illustrated a perspective view of an exemplary lawn crypt 10, which incorporates therein the novel structural member attachment system. The lawn crypt 10 is located below ground level 12 and is covered with an earth fill 14 which is typically on the order of one to three feet thick. In a typical application, the crypt 10 is located completely within an excavated pit. However, in certain applications, the grade of the surrounding ground may require that a portion of the crypt 10 be partially or fully above the ground level 12.

The crypt 10 sits on an unreinforced concrete slab or layer of compacted material 16. Below the slab 16 a drainage system (not illustrated) is provided, as is well-known in the art. The slab 16 sits on earth base 18.

The crypt 10 comprises an array of burial chambers such as chambers 20, 22, 24 and 26, which share adjacent walls. In the depicted embodiment, nine chambers are arranged in a 3×3 array. FIG. 1 illustrates a crypt comprising double-depth burial chambers, i.e., each chamber is divided into an upper tier vault 28 and a lower tier vault 30.

Each chamber is formed by a combination of identical side walls and identical end walls. For example, chamber 20 is formed from opposite side walls 32 and 34 and opposite end walls 36 and 38. The side walls 32 are arranged in parallel rows and within each row the side walls 32 have a common longitudinal axis. The end walls 36 are positioned with vertical longitudinal axes and each end wall 36 is transverse to the rows of side walls 32. Each of the end walls 36 is positioned between respective edges of the side walls 36. In this manner, the side walls 32 and end walls 36 form identical adjacent rectangular burial chambers. The tops of the side walls 32 and end walls 36 of the uppermost tier of each chamber form an uppermost ledge 40 for placing lid forms (shown in FIG. 3 and described below) thereon. As described more fully in FIGS. 2A and 2B below, the side walls 32 and end walls 36 of each tier of each chamber also form a lower ledge (not visible in this view). The lower ledge of upper tier vaults are stackable on top of upper ledges of lower tier vaults. The lower ledge of the bottom-most vaults rest on the slab 16.

Figure 2A:
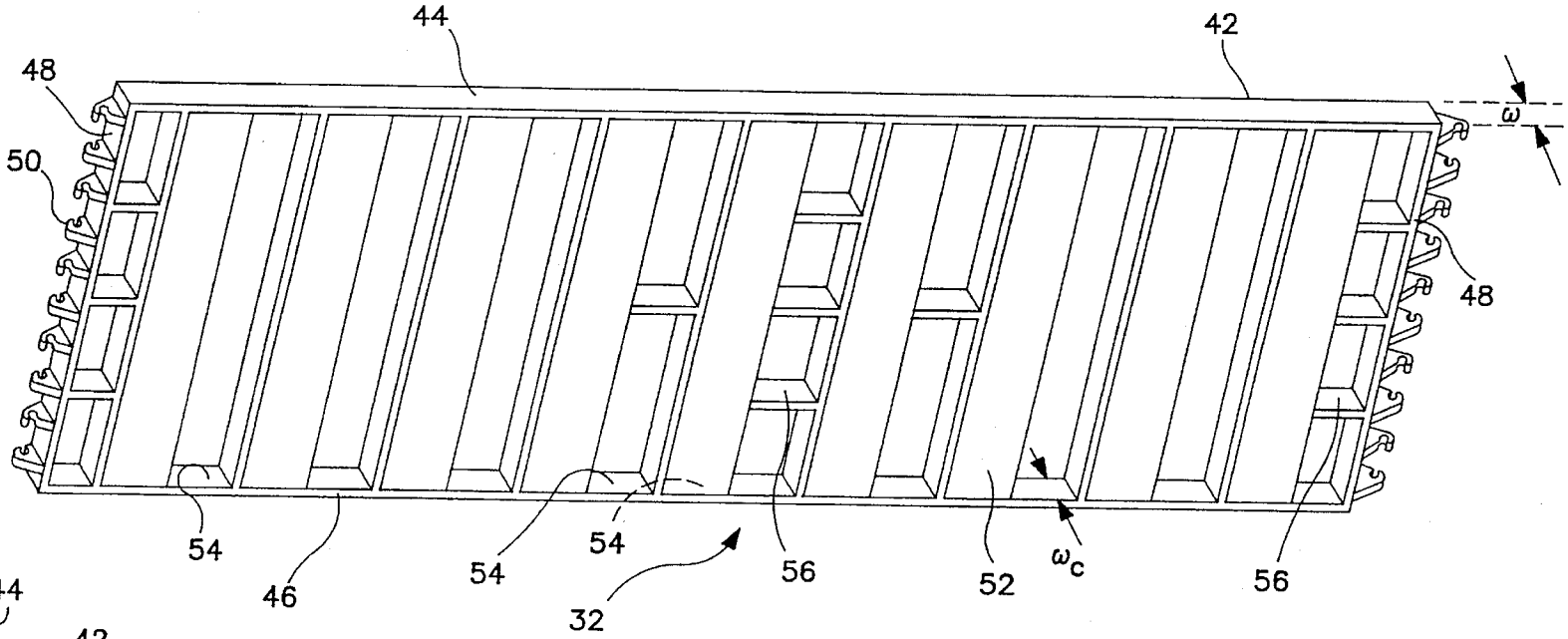
FIGS. 2A and 2B are perspective views of molded structural members in the form of a side wall and end wall, respectively, in accordance with the invention.
Figure 2B:
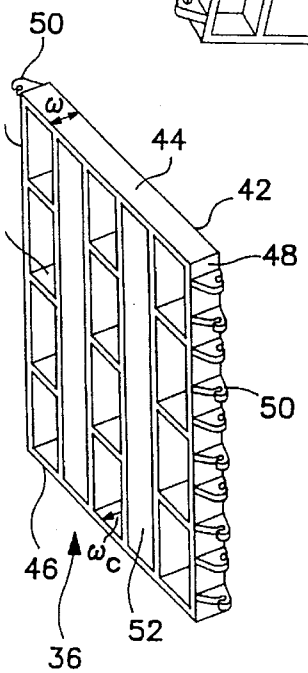

FIG. 2A shows an exemplary side wall 32 of FIG. 1 before it is placed in the crypt structure and FIG. 2B shows an exemplary end wall 36 of FIG. 1 before it is placed in the crypt structure. Turning first to FIG. 2A, the side wall 32 includes a solid wall portion 42 having a top 44, a bottom 46, and opposite sides 48. A plurality of spaced open-shaped protuberances or knuckles 50 project outward from both sides 48. The knuckles 50 form part of a wall attachment system to enable adjacent walls to be attached together, as will be described below in more detail. The end wall 36 in FIG. 2B also includes a solid wall portion 42 having a top 44, a bottom 46, and opposite sides 48, and knuckles 50 projecting outward from its sides.

The side wall 32 and end wall 36 are single solid molded structural plastic members. "Plastic" is used herein in its broadest sense to mean a composition capable of being molded or of receiving form in an initial state and then hardening into a single unitary structural member. The preferred embodiment employs a polymeric material such as a plastic resinous substance (e.g., polypropylene). As noted above, the side walls 32 and end walls 36 are each formed from a single mold. Thus, the knuckles 50 are integrally formed with the wall portion 42. The wall portion 42 of the side walls 32 and end walls 36 is corrugated with square-shaped corrugations 52. The corrugations act as stiffening members and impart rigidity to the walls so they won't flex or buckle under the weight of upper tiers, lids and earth fill above. The corrugations run vertically between the top 44 and bottom 46 of each wall portion 42. The top 44 and bottom 46 of each wall portion 42 has a width, w, which is equal to, and defined by, the width of the corrugations, $w_c$. It should be recognized that the width of the corrugations, $w_c$, need not be the same as the width w. The corrugations may have a width greater or smaller than the width of the top 44 or bottom 46 of the wall portion 42. However, if w is equal to $w_c$, the entire wall portion 42 from the top 44 to the bottom 46 will present a smooth flush face.

The width, w, of the top 44 and bottom 46 of each wall portion 42 forms part of a ledge for either allowing stacking of plural tiers of vaults within each burial chamber or for functioning as part of the uppermost ledge of each burial chamber for supporting a lid form (or a lid after the lid form is filled with concrete) thereon. For example, in FIG. 1, the tops of opposed side wails 32 and opposed end walls 36 of lower tier 30 form a ledge for allowing the upper tier side walls 32 and end walls 36 to be stacked thereupon. The tops of opposed side walls 32 and opposed end walls 36 of upper tier 28 form uppermost ledge 40 for allowing lid forms to be placed thereon.

Figure 9:
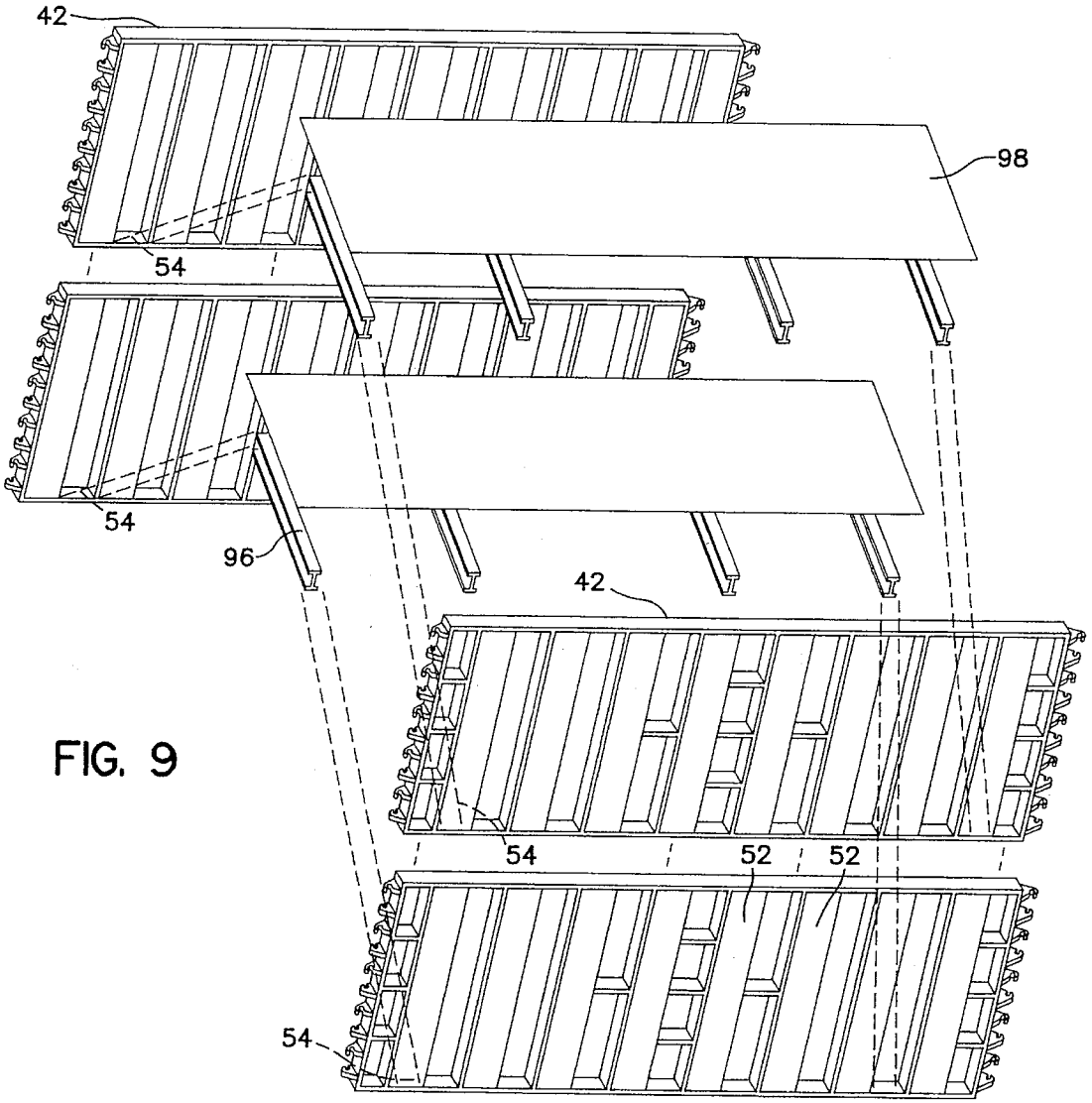
FIG. 9 is an exploded perspective view of a two-tier burial chamber illustrating casket support features in accordance with the present invention.

The square-shaped corrugations 52 define a plurality of inner ledges 54 on the inside of the bottom 46 of each wall portion 42. Nine such inner ledges 54 are visible on the inner facing side of the wall portion 42 in FIG. 2A. Eight such inner ledges 54 are defined on the outer facing side of the wall portion 42 (not visible in this view). Two such inner ledges 54 are labelled in phantom. The corrugations 52 create alternating inner facing and outer facing ledges 54. The inner ledges 54 are useful as support surfaces for casket support beams as depicted in FIG. 9, described below.

The wall portions 42 may optionally have molded-in reinforcing ribs 56 which extend laterally (horizontally) between adjacent like-facing corrugations (i.e., between every other corrugation). Preferably, the ribs 56 are molded into both sides of the wall portion 42.

Figure 3:
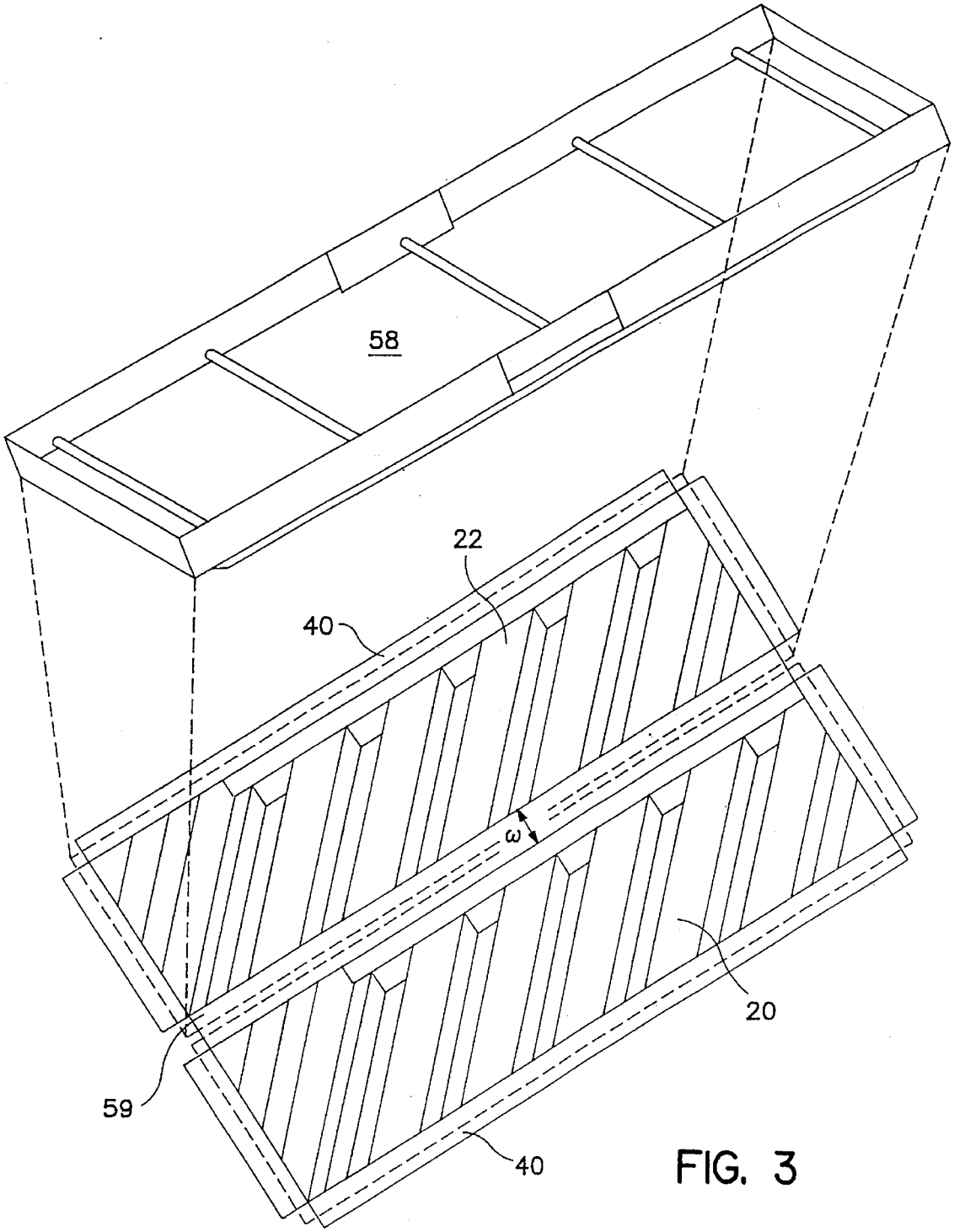
FIG. 3 is an exploded perspective view of two adjacent burial chambers in the lawn crypt of FIG. 1 and a molded lid form for one of the burial chambers, in accordance with the invention.

FIG. 3 shows how lid forms are placed upon ledges of burial chambers prior to being filled with concrete. More particularly, FIG. 3 shows adjacent burial chambers 20 and 22 described in FIG. 1 and illustrates in phantom where a lid form 58 is placed on exemplary burial chamber 22. Since adjacent burial chambers share common walls, the lid form 58 is sized so as to allow each adjoining ledge portion to accommodate two lid forms. Thus, adjoining ledge portion 59 in FIG. 3 accommodates two lid forms, each lid form covering slightly less than one-half of the ledge portion width, w, as outlined in phantom. It should be clear that all ledge portions, except for the ledge portions associated with side walls and end walls of peripheral burial chambers in contact with earth fill, will accommodate two lid forms.

It should also be clear that the lawn crypt can be designed without shared walls. For example, each burial chamber can be formed from separate side walls and end walls. In this alternative embodiment, each burial chamber will have a separate ledge that needs to only accommodate one lid form. However, such an embodiment significantly increases material expenses and the amount of land required.

Figure 4:
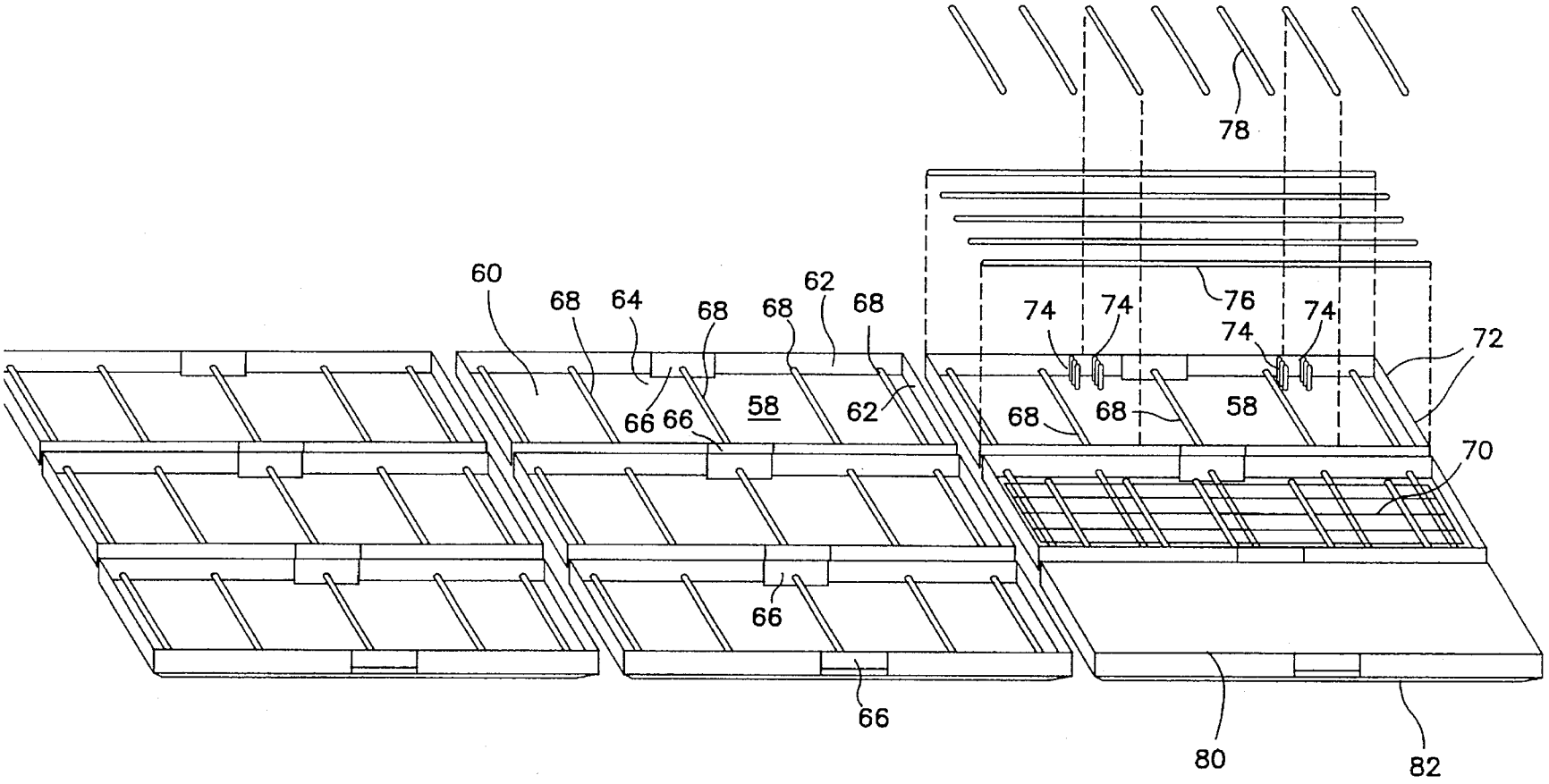
FIG. 4 is a perspective view of the lid forms for covering the entire lawn crypt in FIG. 1 showing the lid forms in various stages of fabrication into finished lids.

FIG. 4 shows a 3×3 array of nine identical lid forms 58 for covering the entire lawn crypt in FIG. 1 and illustrates an important feature of the invention, namely the manner in which lids for covering respective burial chambers are cast in place from the array of lid forms 58. The ability to cast the lids in place provides significant advantages over the prior art procedure of casting the lids off-site using traditional forms and trucking them to the lawn crypt installation location, or the prior art procedure of setting traditional forms on the ground at the installation site and individually filling them with concrete. The latter procedure suffers from a disadvantage that the number of lids that can be made at one time is limited by the number of forms available and the availability of level ground on which to set the forms. As described below, the lid creation technique of the invention does not suffer from any of the drawbacks of traditional lid casting methods.

Once the lawn crypt of FIG. 1 is constructed and the side walls are attached together (described below with respect to FIGS. 6–8), lid forms 58 are placed on the uppermost ledge of each burial chamber, thereby completely covering the entire array of burial chambers.

The lid form 58 is constructed from a single solid molded structural plastic member. The preferred embodiment employs a polymeric material such as plastic resinous substance (e.g., polyethylene). The lid form 58 includes a solid bottom 60 and straight side walls 62 which together, form a recess 64. The lid form 58 also includes an indent or angled section 66 (i.e., a molded-in socket) formed along the middle portion of opposite side walls 62 for allowing a lid to be removed and replaced when access to the burial chamber below is desired. The angled section 66 is shaped so that a clamp-type or tong-type lifting device can fit within spaces between adjacent lid forms formed by the indent of the angled section 66. The lid form 58 optionally includes molded-in reinforcing ribs 68 extending across the solid bottom 60 and joining opposite side walls 62.

Once all of the lid forms 58 are placed on top of the burial chamber ledges, a concrete reinforcing material such as rebar 70 is placed in each of the lid form recesses 64. In accordance with another important feature of the invention the rebar 70 is held in place and elevated within the recess 64 by saddle-type sockets 72 and extension ribs 74 (both shown more clearly in FIG. 5). These sockets 72 and ribs 74 are also integrally molded into the lid form. In this manner, the rebar 70 need not be tied together to keep it from moving about when concrete is poured into the lid form recess 64, thereby resulting in savings in time and material cost. The sockets 72 and ribs 74 also help to ensure that the rebar 70 is correctly located within the lid form recess 64.

In the depicted embodiment, the rebar 70 includes parallel spaced horizontal bars 76 and parallel spaced vertical bars 78. During installation, the horizontal bars 76 are placed in the lid form recess 64. Respective ends of the horizontal bars 76 are then fit into the saddle-type sockets 72. A series of such sockets 72 are shown along the right-hand side of the upper right lid form 58. The optional reinforcing ribs 68 extending across the solid bottom 60 of the lid form 58 aid in elevating and supporting the horizontal bars 76 within the recess 64. Next, the vertical bars 78 are placed on top of the horizontal bars 76. The ends of the vertical bars 78 are fit into a space between adjacent extension ribs 74. The space is sized so as to be slightly greater than the diameter of a vertical bar 78 so that the bar fits snugly therein. Two pairs of such extension ribs 74 are shown along the 10 far side of the upper right lid form 58.

It should be understood that the rebar 70 may also be formed from a single unitary structure of bars seated into saddle sockets and spaces between extension ribs.

Figure 5:
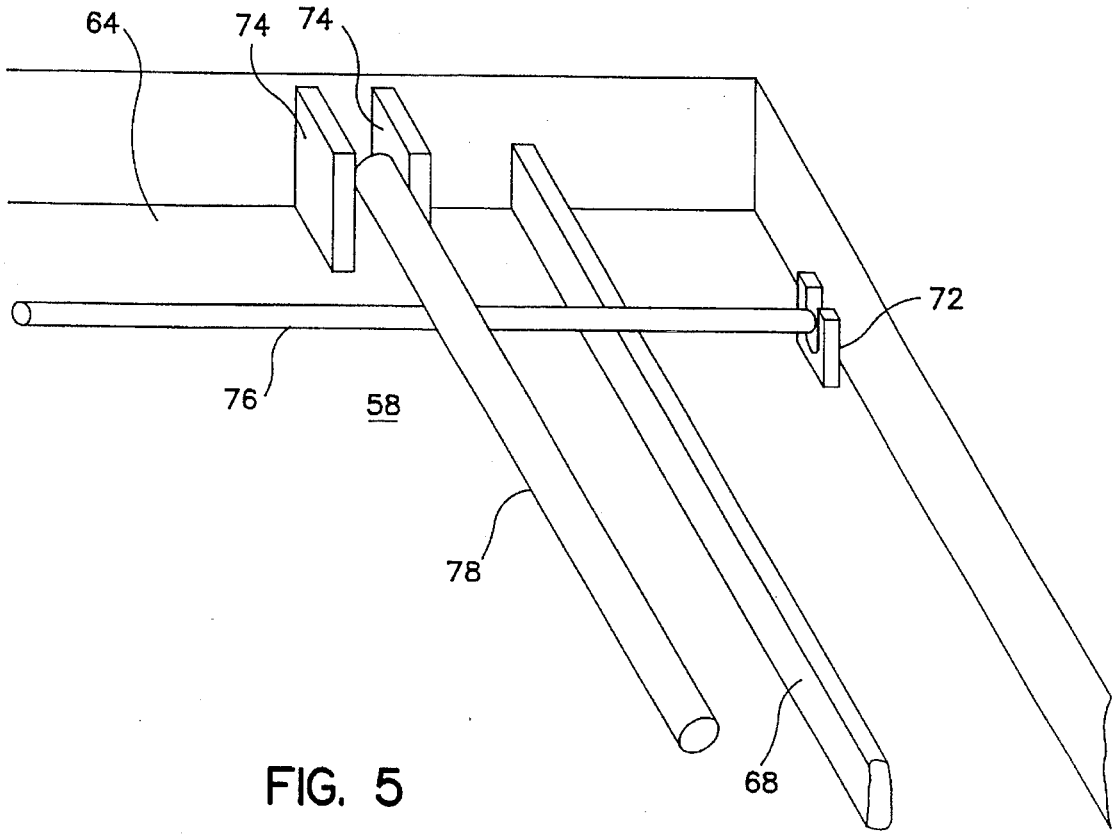
FIG. 5 is an enlarged view of a portion of the lid form in FIG. 4 illustrating in detail molded-in sockets and extension ribs for restraining concrete reinforcing material within the lid form.

FIG. 5 shows a corner portion of a lid form 58 illustrating in more detail a saddle-type socket 72 and an extension rib 74 for restraining a horizontal bar 76 and a vertical bar 78 of the rebar 70. Opposed sockets and ribs for restraining the other ends of the bars are not visible in this view. The saddle-type socket 72 is rib-shaped with a half-moon cutout therein for receiving and restraining the horizontal bar 76. The extension rib 74 is also rib-shaped but does not have any cutout portion. In the depicted embodiment of. FIGS. 4 and 5, the sockets 72 and the extension ribs 74 are molded into recess 64 near or at its inside edges (i.e., along the inside perimeter). It should be recognized, however, that the sockets 72 and the extension ribs 74 can be molded into the recess 64 anywhere, so long as their placement aligns with the placement of the bars of the rebar 70.

Once the rebar 70 is in place, a suitable retaining wall (not shown) is erected around the entire perimeter of the lawn crypt 10 to protect the burial chambers 20 from lateral soil pressures. Next, the lid forms 58 are filled with concrete 80 (either by pouring or pumping) and troweled smooth. "Concrete" is used herein its broadest sense to mean a mass formed by coalescence or concretion of particles of matter. In the preferred embodiment, the concrete is a cement aggregate. In this manner, each lid form 58 creates a lid, exemplified by lid 82 shown in the bottom right corner of the array in FIG. 4. The lid forms 58 are not removed, as with prior art lid forms. Rather, the lid forms 58 becomes part of the lid itself. Once the concrete in the lid forms has hardened or cured for an appropriate amount of time, the entire upper surface of the lawn crypt 10, including the lids 82 are covered over with earth fill. If desired, grass can be planted on the earth fill.

When access to a particular burial chamber (e.g., 20, 22, 24 or 26) is desired for placing a casket therein, earth moving equipment uncovers the soil and grass on top of a portion of the lawn crypt 10, revealing the concrete reinforced plastic lid 82. A clamp-type lifting device clamps onto the angled sections 66 of the lid 82 and lifts it up, thereby exposing the burial chamber below.

Figure 6:
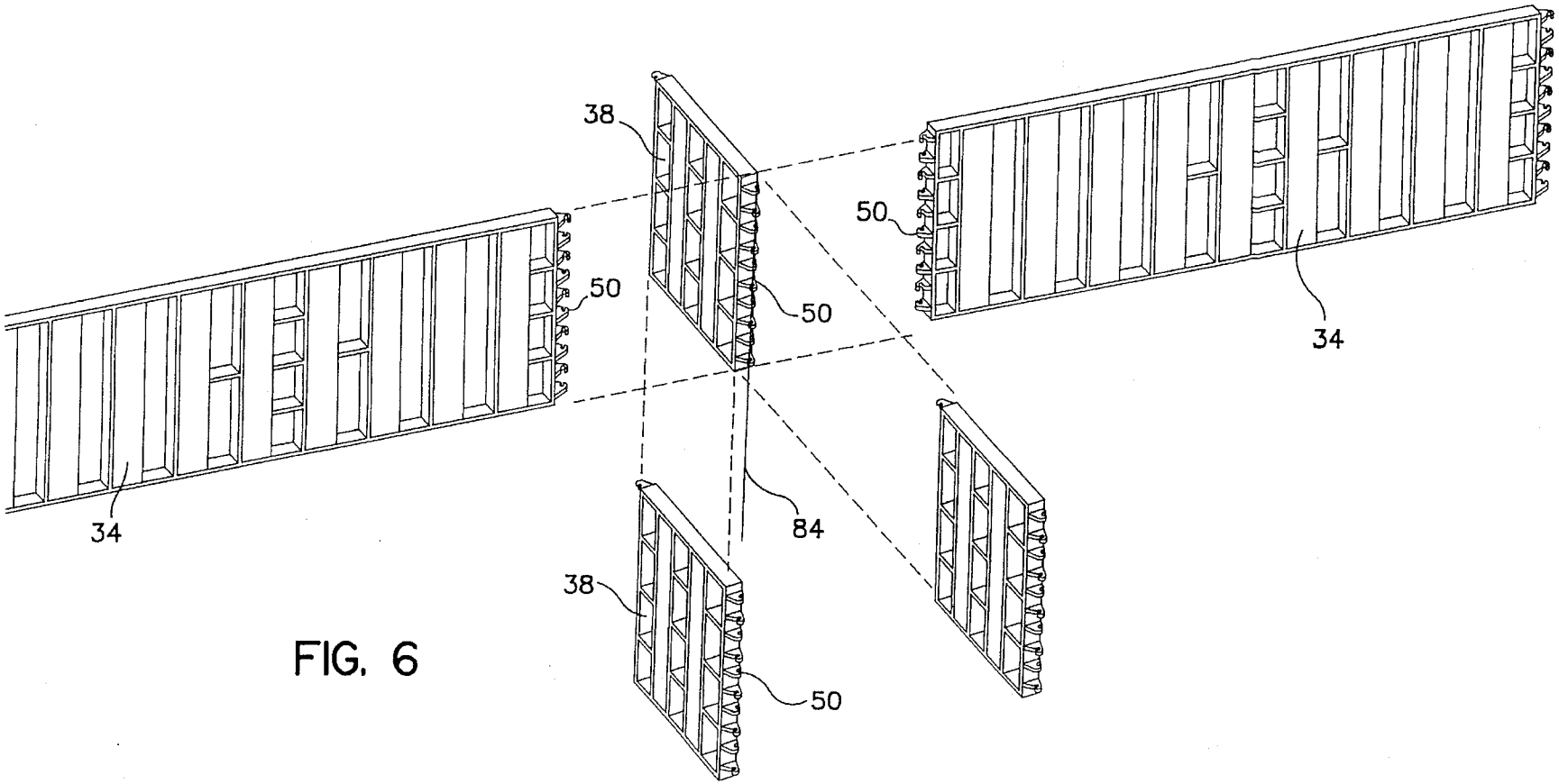
FIG. 6 is an exploded perspective view illustrating adjacent structural members corner pin for their attachment to one another.

FIG. 6 shows the manner in which adjacent molded structural members in the form of side walls 34 and end walls 38 of FIG. 1 are attached together. In accordance with another important feature of the invention, adjacent side walls and end walls are attached together by a corner pin 84 inserted through their respective knuckles 50. The corner pin 84 serves to inhibit lateral movement between two adjacent walls. When a double-depth (two-tier) lawn crypt is constructed, the corner pin 84 is made sufficiently long so as to extend through the knuckles 50 of upper tier and lower tier walls. The corner pin 84 may be formed from any suitable material such as steel or the like.

Figure 7:
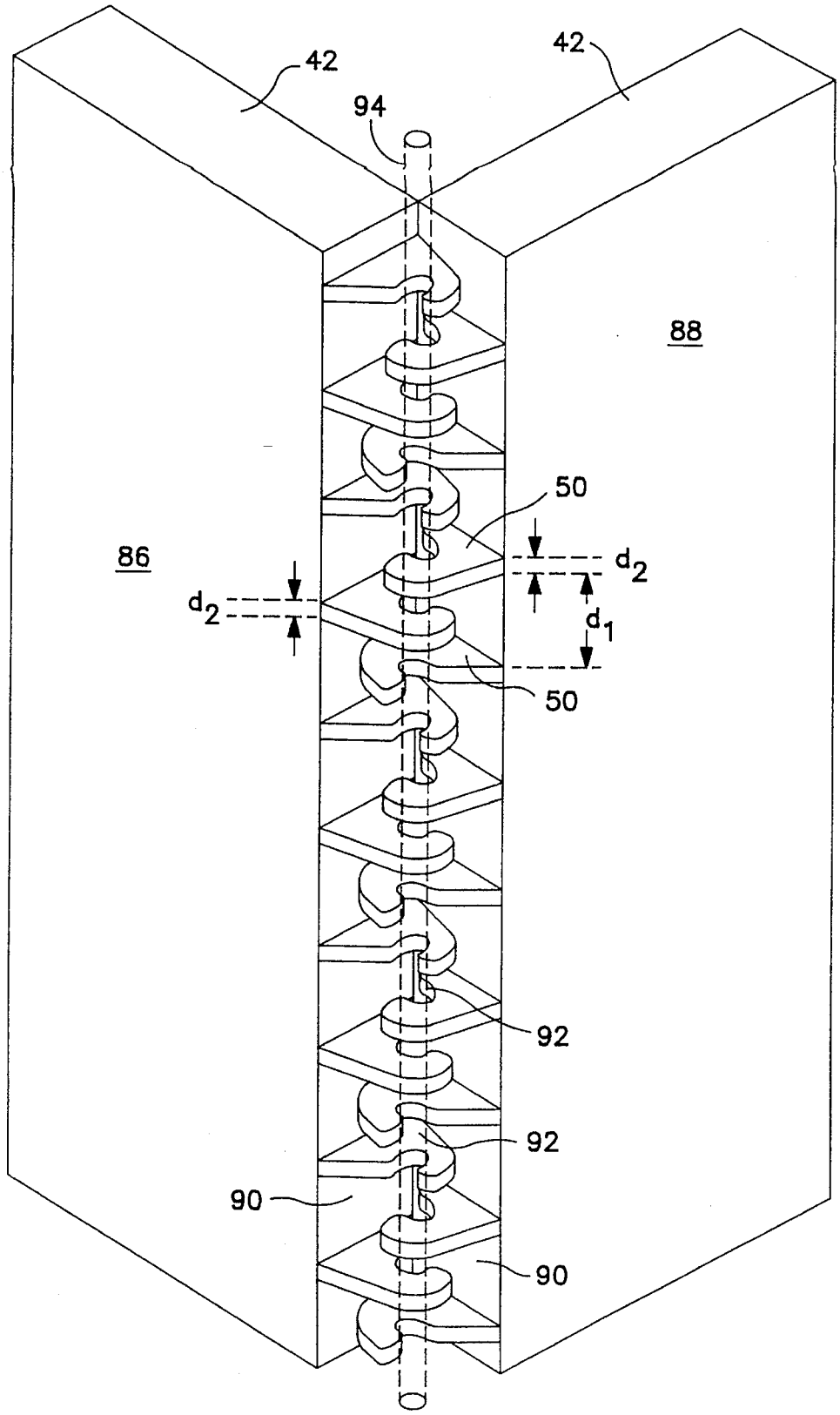
FIG. 7 is a perspective view of two adjacent structural members illustrating protuberances of the adjacent members interengaged with one another.
Figure 8:
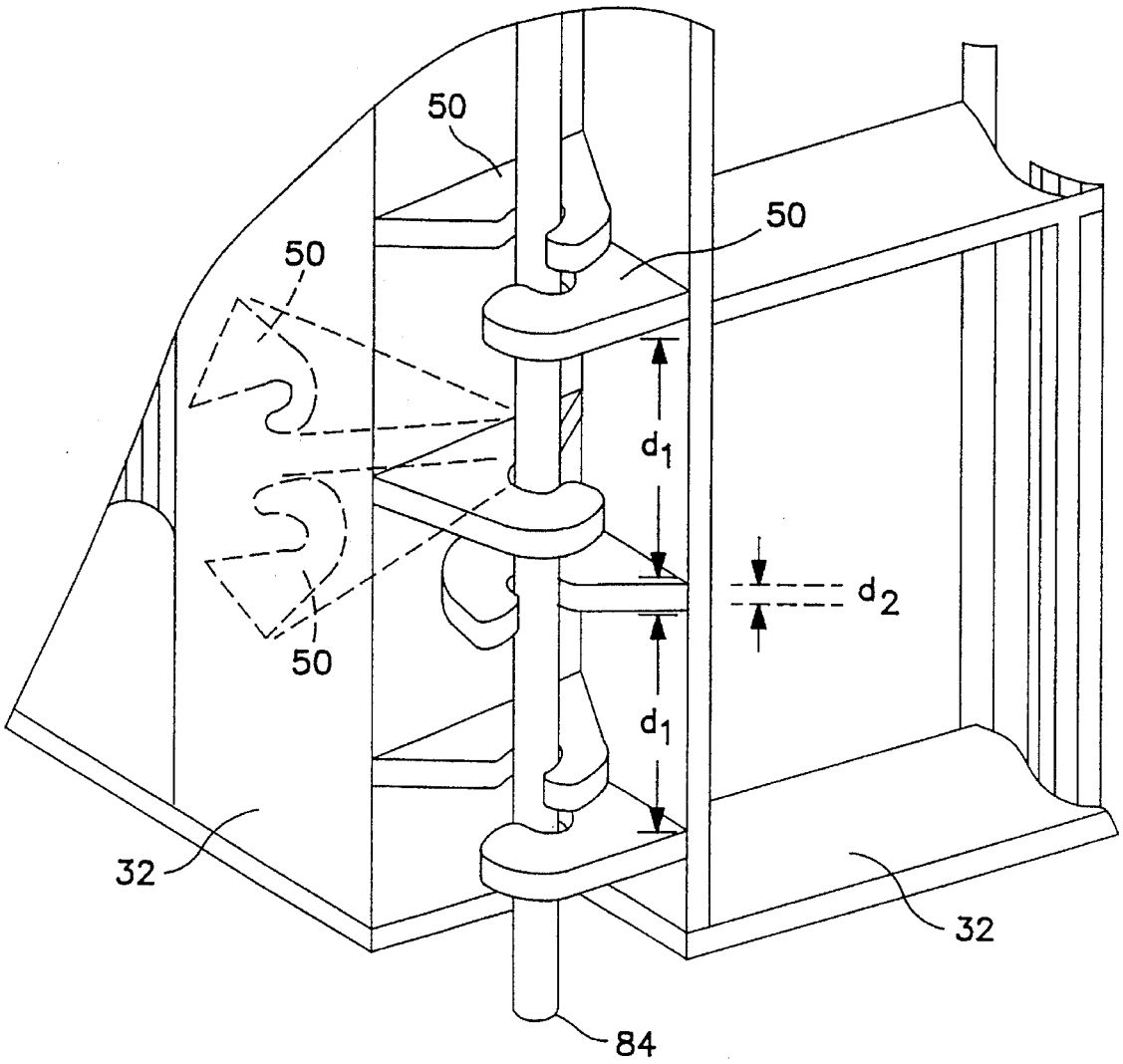
FIG. 8 is an exploded perspective view illustrating two adjacent structural members with a corner pin inserted within the interengaging protuberances, and also illustrating two additional protuberances (shown in phantom) belonging to two additional adjacent structural members, respectively.

The details of the wall attachment system is best illustrated with respect to FIGS. 7 and 8. FIG. 7 shows two adjacent structural members 86 and 88 at right-angles to one another. For example, in the lawn crypt embodiment of FIG. 1, the structural members 86 and 88 represent a side wall 32 and an end wall 36. As described above, the knuckles 50 are integrally formed with the wall portion 42 in a single mold. The open shape of the knuckle is an important feature of the invention. By selecting a knuckle shape that has an open form, for example a c-shape or half-circle, no complicated or expensive molds are required to form the structural member. Although it is known to employ full-circle knuckles (a closed form) at the sides of structural members and to insert pins therethrough for connecting adjacent structural members, creating a single molded structural member with full-circle knuckles integrally attached thereto would require complicated or expensive molds with slides, pulls, or other moving parts. In contrast, the integrally molded structural members employed in the instant invention can be formed in a standard mold without such slides, pulls or other moving parts. The resultant structural member can receive a pin through the knuckles and functions adequately to inhibit lateral movement between adjacent structural members.

Turning again to FIG. 7, structural member 88 includes a plurality of spaced knuckles 50 extending outward from opposite sides 90. FIG. 7 shows only the left-hand side of the structural member 88 and the right-hand side of structural member 86. In accordance with another important feature of the invention, every adjacent knuckle 50 opens in the opposite direction. Therefore, every other knuckle 50 opens in the same direction. The knuckles 50 are axially aligned along the side 92 so that an unobstructed passage 94 (shown in phantom) is defined perpendicular to the knuckles 50. The passage 94 intersects a space 92 defined by the half-circle or c-shaped portion of each knuckle 50. Furthermore, the knuckles 50 on one side of each structural member 86, 88 are staggered relative to the knuckles 50 on the other side (not shown) and sufficient spacing exists between adjacent knuckles 50 so as to allow at least one other knuckle to fit therebetween. In FIG. 7, the spacing between adjacent knuckles 50 is represented as $d_1$ and the width of each knuckle is $d_2$, wherein $d_1$ is greater than $d_2$. In this manner, the knuckles 50 on one side of a structural member 88 will always interengage or interfit in the spaces between the knuckles 50 of a side of an adjacent structural member 86. It should be recognized that if all of the structural members are identical (e.g., in the exemplary embodiment, if only side walls 32 or only end walls 36 were employed to build a lawn crypt), like sides must not be placed adjacent to one another.

FIG. 8 shows the concept illustrated in FIG. 7, as employed in adjacent walls of the lawn crypt system of the present invention. Side wall 32 is placed adjacent to, and at right angles with end wall 36 so that their respective knuckles 50 interengage or interfit. Corner pin 84 is then inserted from above into at least a portion of the unobstructed passage 94.

In order to minimize construction time and material cost, four adjacent walls of each tier can be attached together with one corner pin 84, as shown in FIG. 6, described above. In such an embodiment, there must be sufficient space between adjacent knuckles 50 so as to allow three knuckles 50 to fit therebetween. Thus, $d_1$ must be at least three times greater than $d_2$. FIG. 8 shows, in phantom, two additional knuckles 50 that will interfit between two adjacent knuckles 50 of side wall 32. In order to facilitate a four corner attachment system, it is necessary for the knuckles of side walls to be staggered with respect to the knuckles of end walls, as well as for the knuckles of each side of the side walls and end walls to be staggered with respect to each other. The staggering must be arranged so that knuckles of four sides (two end wall sides and two side wall sides) can interfit without interfering with each other. Thus, there will be four different sets of staggered knuckles. Of course, if it is only desired to create single closed polygonal forms, only two sets of staggered knuckles will be required.

FIG. 9 shows additional features of each burial chamber, namely the casket support and tier dividing features, as viewed in a two-tier burial chamber. After the walls are set in place (as shown in FIG. 1) and the corner pins are inserted, but before the lid forms are placed on top of the burial chambers, casket support beams 96 are set in place on inner ledges 54 of wall portions 42. As described above in FIG. 2A, corrugations 52 define alternating inner facing and outer facing inner ledges 54 on the inner bottom of each of the wall portions 42 which function as support surfaces for casket support beams. FIG. 9 shows four such casket support beams 96. Each support beam 96 straddles two opposite facing inner ledges 54. The ends of each support beam 96 fit into and rest on the inner ledges 54. The set of support beams 96 placed in the lower tier of the burial chamber function to raise the casket placed thereon so that it does not rest directly on the burial chamber floor. The support beams 96 also help prevent the wall portions 42 from bending inward from any lateral forces applied thereagainst.

Optionally, a casket divider 98 may be placed on the support beams 96 (and the casket may then be placed on the divider 98) so as to hide the bare concrete floor or compacted material from view when peering down into the burial chamber. The casket divider 98 has a purely aesthetic function and does not serve any structural purpose.

In a two-tier lawn crypt, another set of casket support beams 96 are placed between opposite sides of upper tier wall portions 42, straddling their opposite facing inner ledges 54. This set of support beams 34 helps to prevent the upper tier wall portions 42 from bending inward from any lateral forces applied thereagainst. Another divider 98 may optionally be placed on top of the upper set of support beams 96 to hide the lower tier from view when peering down into the burial chamber.

In the preferred embodiment, the casket support beams 96 are trussed I-beams molded from a suitable plastic material. The casket dividers 98, may comprise a rigid plastic sheet.

When access to a particular burial chamber is desired for placing a casket therein, earth moving equipment uncovers the soil and grass on top of a portion of the lawn crypt, thereby allowing a clamp-type lifting device to remove the lid above the particular burial chamber. In a two-tier lawn crypt, the lower tier would typically be filled first. Thus, the upper tier divider 98 and upper tier support beams 96 are temporarily removed so as to allow access to the lower tier of the burial chamber. After the casket is placed on top of the previously set in place lower tier support beams 96 and/or divider 98, the upper tier support beams and upper tier divider 98 are put back in place. If a double burial is set to occur, the upper tier of the chamber is filled with the second casket. However, it is more likely that the upper chamber will remain unfilled at this time and will be filled at a later date by repeating the access procedure above. However, during subsequent access neither the upper tier nor lower tier support beams 96 or dividers 98 will be need to be removed or manipulated.

Another important feature of the particular molded structural members shown in the exemplary embodiment is that they are self-seating. This feature is best illustrated with respect to FIGS. 6 and 7. By employing structural members with sides 90 at right angles to their faces and knuckles 50 which extend axially outward from the sides at right angles, adjacent structural members at right angles to one another will automatically be properly positioned for pin insertion when their inside corner edges touch. In this manner, two, three or four adjacent structural members can be easily properly positioned by mere visual and/or tactile feel. FIG. 6 shows a portion of an upper tier with four adjacent structural members before they are brought into contact. This self-seating feature reduces the need for alternative alignment tools when assembling the individual burial chambers of the lawn crypt, thereby reducing installation time and complexity.

It should be recognized that the structural member attachment concepts shown in the exemplary embodiment can be employed to create polygonal structural shapes other than rectangles. For example, hexagonal or pentagonal structures having honeycomb shaped compartments can be constructed. Likewise, triangular structures can be created. The hexagonal or pentagonal structures have either two or three adjacent corners, depending upon whether the structural members meet at outer peripheral walls or at inner walls. Likewise, the triangular structures will have either three, four or six adjacent corner. The only modification that would be required from the exemplary embodiment would be to adjust the spacing between adjacent knuckles of each structural member and the angle of the wall end line. For example, a triangular structure will require a spacing between adjacent knuckles sufficient to allow up to five knuckles of adjacent structural members meeting at inner walls to fit therebetween.

Although the knuckles shown in the exemplary embodiment 10 have a half-circle or c-shape, it should be recognized that the scope of the invention is not limited to only these shapes. Any open-type protuberance shape which can be formed in a simple mold and which inhibits lateral movement between adjacent members is considered to be within the scope of the invention.

It should be further recognized that as long as the lid forms for such structures approximately match the shape of the polygonal form, the lid forms can still be cast in place to create lids in the same manner as described above with respect to the exemplary embodiment.

It should further be recognized that lid forms 58 in FIG. 4 need not be so close together as to be touching one another. A small gap can exist between adjacent lid forms 58, or spacing may be placed therebetween, without interfering with the ability to remove and replace the lids 82 at a future date. It is only important that concrete not be poured and left to harden in such a manner that access to the angled section 66 is impaired. It is also important that the lid forms 58 are not so overfilled with concrete that two adjacent lids become hardened and stuck to one another. Troweling smooth the wet concrete should prevent this latter problem from arising.

A typical 100–200 unit lawn crypt system of the invention can be completely installed in about two weeks. In contrast, the installation time using traditional methods of construction can run up to ten months.

All of the components necessary to construct a lawn crypt of approximately 100 double-depth burial chambers or 180 single-depth burial chambers, including the structural members, lid forms, rebar, casket supports, dividers and pins, can be loaded on a single standard flat bed truck. In contrast, the same truck will only hold the components of a maximum of 8–10 prior art double-depth concrete-walled burial chambers. Thus, a substantial savings in shipping costs are realized by employing the molded plastic structural members of the invention.

The novel lawn crypt construction system described above provides significant advantages not possible or even contemplated by prior art lawn crypt construction systems. The employment of novel molded plastic structural members decreases installation time and complexity by allowing side walls to be constructed of light-weight, easily positionable and maneuverable parts. The open knuckles at the sides of the structural members allows the members to be formed in a simple mold. The alternating, spaced knuckles also allow for adjacent walls and tiers of stacked walls to be attached together with simple pins. The sides of the side walls are arranged so that adjacent members can be aligned by mere sight or tactile feel, and without employing any alignment tools. The molded plastic lid forms allow for burial chamber lids to be cast in place, thereby saving significant amounts of time. The molded-in sockets and extension ribs in the lid forms which position and restrain the bars of the concrete reinforcing material allows for savings in installation time and material cost.

The present invention may be embodied in other specific forms without departing from the spirit or essential attributes thereof and, accordingly, reference should be made to the appended claims, rather than to the foregoing specification, as indicating the scope of the invention.

We claim:

1. A burial crypt comprising:

(a) adjacent burial chambers, each burial chamber being defined by a plurality of vertical walls, the uppermost portion of the vertical walls defining an upper ledge; and (b) a lid placed on the upper ledge of each respective burial chamber, thereby covering each respective burial chamber, the lid constructed from a unitary molded lid form filled with concrete reinforcing elements and concrete, the lid form including;

(i) a solid bottom;

(ii) side walls extending upward from the solid bottom, the side walls and bottom together defining a concrete-receiving recess; and (iii) socket means on an interior surface of the lid form for restraining the concrete reinforcing elements, the socket means comprising spaced saddle sockets extending upward from the solid bottom and the concrete reinforcing elements comprising concrete reinforcing bars and individual bars.

2. A burial crypt according to claim 1, wherein the socket means further comprises spaced pairs of extension ribs for restraining individual bars when the lid form is filled with concrete.

3. A burial crypt according to claim 2, wherein the saddle sockets restrain horizontally placed concrete reinforcing bars to form a plurality of substantially linear axes along a horizontal plane and the extension ribs restrain individual bars oriented perpendicular to the linear axes and substantially along the horizontal plane of concrete reinforcing bars, the individual bars being shorter than the concrete reinforcing bars and being placed on top of the concrete reinforcing bars.

4. A burial crypt comprising:

(a) adjacent burial chambers, each burial chamber being defined by a plurality of vertical walls, the uppermost portion of the vertical walls defining an upper ledge; and (b) a lid placed on the upper ledge of each respective burial chamber, thereby covering each respective burial chamber, the lid constructed from a unitary molded lid form filled with concrete reinforcing elements and concrete, the lid form including;

(i) a solid bottom;

(ii) side walls extending upward from the solid bottom, the side walls and bottom together defining a concrete-receiving recess; and (iii) socket means on an interior surface of the lid form for restraining the concrete reinforcing elements; and (iv) reinforcing ribs integrally molded into the solid bottom and extending across the solid bottom of the lid form for reinforcing the lid form, supporting the concrete reinforcing elements within the lid form, and elevating the concrete reinforcing elements from the lid form bottom.

5. A unitary molded structural member for building wall sections of adjacent molded structural members that are inhibited from lateral movement therebetween, the member comprising:

(a) a polygonal wall portion including two opposite straight sides, a top and a bottom each having a preselected width, the space between the top and bottom having vertically extending corrugations, the width of the corrugations being substantially similar to the width of the top and the bottom; and (b) a plurality of spaced protuberances extending outward from the sides, each protuberance defining a partially enclosed space, every adjacent protuberance opening in the opposite direction, the protuberances axially aligned along the sides so that an unobstructed passage exists perpendicular to the protuberances which intersects a space defined by the partially enclosed spaces the protuberances on one of the sides being staggered relative to the protuberances on the other side so that (i) protuberances on one side of an adjacent structural member interfit in the spaces between the protuberances of one of the sides of said member, and (ii) a pin can be inserted through the passage of adjacent interfit members, thereby inhibiting lateral movement therebetween.

6. A unitary molded structural member according to claim 5, wherein the wall portion further includes a plurality of molded-in horizontally extending cross ties which join adjacent like-facing vertical corrugations.

7. A unitary molded structural member according to claim 5, wherein the corrugations are square-shaped.

8. A burial crypt comprising:

(a) adjacent burial chambers sharing common vertical walls, each burial chamber being defined by a plurality of vertical walls, the uppermost portion of the vertical walls defining an upper ledge, the burial chambers built from structural members, each structural member including (i) a wall portion including two opposite straight sides; and (ii) a plurality of spaced protuberances extending outward from the wall ends, each protuberance defining a partially enclosed space, every adjacent protuberance opening in the opposite direction, the protuberances axially aligned along the wall ends so that an unobstructed passage exists perpendicular to the protuberances which intersects a space defined by the partially enclosed spaces, the protuberances on one of the wall ends being staggered relative to the protuberances on an adjacent wall end so that protuberances on one wall end of an adjacent member interfit in the spaces between the protuberances of one of the adjacent wall end of said member;

(b) a passage formed by the partially enclosed space in the protuberances of adjacent interfit wall ends;

(c) corner pills for insertion through the passage for inhibiting lateral movement between adjacent walls; and (d) a lid placed on the upper ledge of each respective burial chamber, thereby covering each respective burial chamber.

9. A burial crypt according to claim 8, wherein the wall portion further includes a top and bottom having a preselected width, the space between the top and bottom having vertically extending corrugations, the width of the corrugations being substantially similar to the width of the top and bottom.

10. A burial crypt according to claim 9, wherein the wall portion further includes a plurality of molded-in horizontally extending cross ties which join adjacent like-facing vertical corrugations.

11. A burial crypt according to claim 9, further comprising:

(d) casket support beams placed across opposed walls of a burial chamber and resting on spacing on the inside bottom of the wall portion between adjacent corrugations.

12. A burial crypt according to claim 9, wherein the corrugations are square-shaped.

13. A burial crypt according to claim 8, wherein the partially enclosed space of the protuberance is a half-circle.

14. A burial crypt according to claim 8, wherein the top and bottom of each of the wall portions defines a wall portion upper ledge and a wall portion lower ledge, respectively, the structural members being stackable one atop another to form a double-depth crypt by placing a wall portion lower ledge of a first structural member on top of a wall portion upper ledge of a second member and aligning protuberances thereon, the corner pins being inserted through a passage defined by the partially enclosed spaces of the protuberances of the wall ends.

15. A burial crypt according to claim 8, wherein the space between adjacent spaced protuberances of said each said wall end has a preselected distance so as to allow at least two staggered protuberances from adjacent wall ends to fit therebetween, thereby allowing a single corner pin to be inserted into a passage which intersects the space defined by the partially enclosed spaces of protuberances of at least a total of three wall ends.

* * * * *